US007658307B2

(12) United States Patent
Skupin

(10) Patent No.: US 7,658,307 B2
(45) Date of Patent: Feb. 9, 2010

(54) TOOL BAG WHICH CAN BE CARRIED NEXT TO THE BODY OF A PERSON

(75) Inventor: Klaus Peter Skupin, Stuttgart (DE)

(73) Assignee: ZYRUS Beteiligungsgesellschaft mbH & Co. Patente I KG, Schönefeld/OT Waltersdorf (DE)

( * ) Notice: Subject to any disclaimer, the term of this patent is extended or adjusted under 35 U.S.C. 154(b) by 333 days.

(21) Appl. No.: 10/474,534

(22) PCT Filed: Apr. 11, 2002

(86) PCT No.: PCT/DE02/01338

§ 371 (c)(1),
(2), (4) Date: Oct. 10, 2003

(87) PCT Pub. No.: WO02/083371

PCT Pub. Date: Oct. 24, 2002

(65) Prior Publication Data

US 2004/0099705 A1 May 27, 2004

(30) Foreign Application Priority Data

Apr. 18, 2001 (DE) ..... 101 19 007

(51) Int. Cl.
*A45F 5/00* (2006.01)
*A45C 13/30* (2006.01)
*A45F 5/02* (2006.01)

(52) U.S. Cl. ..... 224/681; 224/219; 224/222; 224/245; 224/650; 224/653; 224/657; 224/674; 224/675; 224/904

(58) Field of Classification Search ..... 224/219, 224/222, 242, 245, 645, 650, 653, 674, 675, 224/676, 681, 904, 657
See application file for complete search history.

(56) References Cited

U.S. PATENT DOCUMENTS 1,213,758 A 1/1917 Delaney
1,465,281 A * 8/1923 Morrison ..... 224/671
1,675,072 A 6/1928 Watermon (Continued)

FOREIGN PATENT DOCUMENTS

DE 29709358 9/1997

(Continued)

OTHER PUBLICATIONS

International Search Report for PCT/DE02/01338 filed on Apr. 11, 2002 that was mailed on Sep. 25, 2002. 6 pages.

(Continued)

*Primary Examiner*—Gary E Elkins
(74) *Attorney, Agent, or Firm*—Collard & Roe, P.C.

(57) ABSTRACT

The invention relates to a tool bag which can be carried next to the body of a person, the tool bag comprising at least one receiving element for at least one tool. The inventive tool bag respectively comprises a three-dimensional flexible safety chord for each tool associated with a receiving element. The chord can be fixed to the associated tool, and can be fixed to the tool bag in such a way that it can be extracted and automatically retracted by means of an extracting and retracting device.

14 Claims, 4 Drawing Sheets

U.S. PATENT DOCUMENTS

Figure 1:
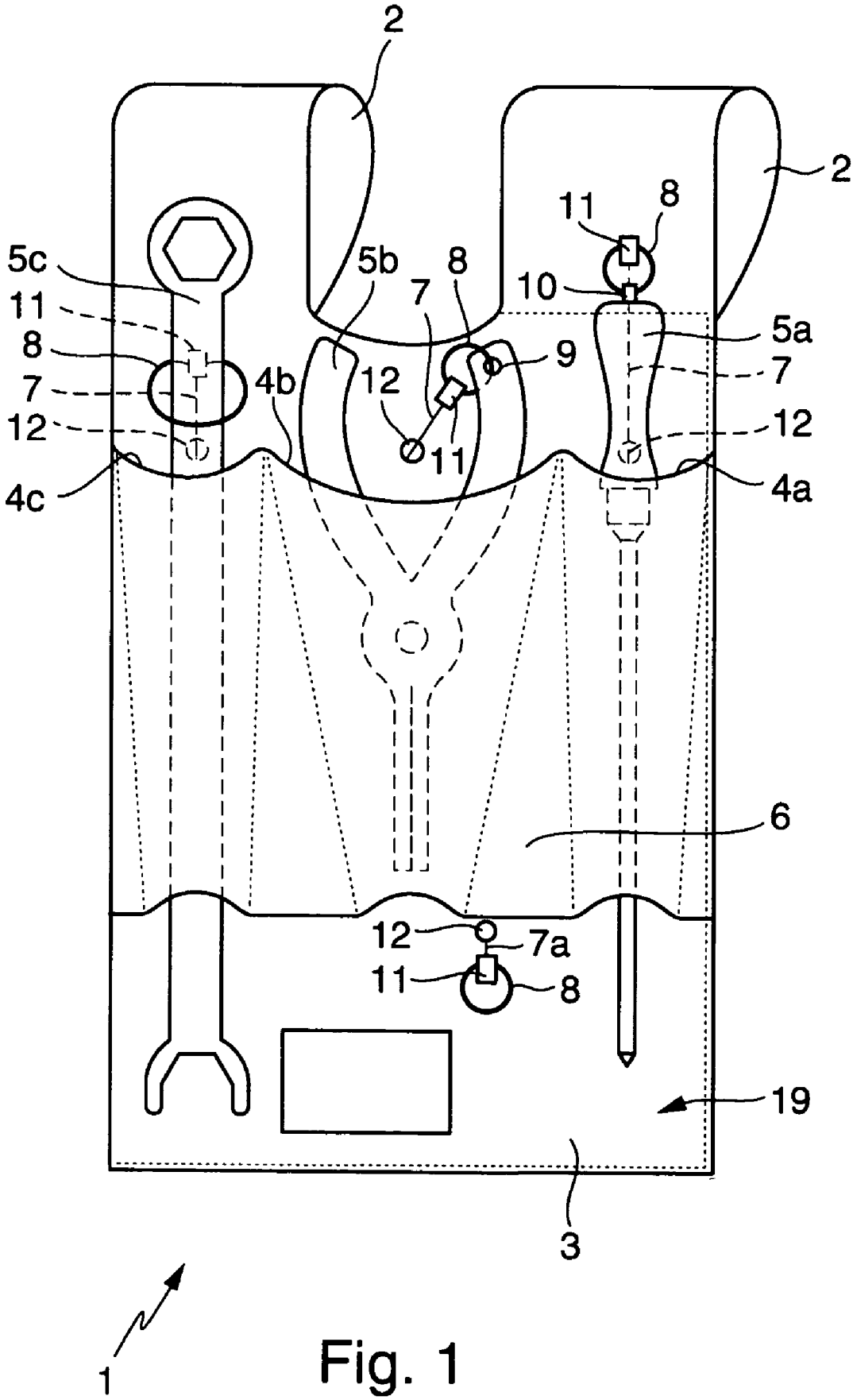

| | | | | | |
|---|---|---|---|---|---|
| 2,324,194 | A | * | 7/1943 | Campiglia | 224/623 |
| 2,400,417 | A | * | 5/1946 | Hickey | 224/637 |
| 2,636,751 | A | * | 4/1953 | Carlson | 281/45 |
| 2,793,617 | A | * | 5/1957 | Palmer | 224/162 |
| 4,486,169 | A | | 12/1984 | Lewis | |
| 4,621,589 | A | * | 11/1986 | Thinnes | 119/770 |
| 4,921,153 | A | * | 5/1990 | Smith | 224/683 |
| 4,986,459 | A | * | 1/1991 | Yarbrough, Jr. | 224/661 |
| 5,139,187 | A | * | 8/1992 | Fowler | 224/576 |
| 5,409,152 | A | * | 4/1995 | Trevino | 224/657 |
| 5,513,785 | A | * | 5/1996 | Campagna, Jr. | 224/162 |
| 5,524,749 | A | * | 6/1996 | Thompson et al. | 150/147 |
| 5,653,337 | A | * | 8/1997 | Cirigliano | 224/904 |
| 6,196,437 | B1 | * | 3/2001 | Smith, III | 224/657 |
| 6,244,486 | B1 | * | 6/2001 | Holland et al. | 224/584 |
| 6,257,469 | B1 | * | 7/2001 | Cohn | 224/162 |
| 2005/0258203 | A1 | * | 11/2005 | Weaver | 224/904 |

FOREIGN PATENT DOCUMENTS

| | | | |
|---|---|---|---|
| FR | 669 230 | A | 11/1929 |

OTHER PUBLICATIONS

International Preliminary Examination Report for PCT/DE02/01338 filed on Apr. 11, 2002 that was completed on Apr. 9, 2003.

* cited by examiner

TOOL BAG WHICH CAN BE CARRIED NEXT TO THE BODY OF A PERSON

CROSS REFERENCE TO RELATED APPLICATIONS

Applicant claims priority under 35 U.S.C. §119 of German Application No. 101 19 007.7 filed on Apr. 18, 2001. Applicant also claims priority under 35 U.S.C. §365 of PCT/DE02/01338 filed on Apr. 11, 2002. The international application under PCT article 21(2) was not published in English.

This invention relates to a tool bag having at least one receptacle for at least one tool that can be worn on the body of a person.

Tool bags are used, for example, by carpenters, roofers, elevator engineers, chimney builders and head maintenance men. These tool belts are usually worn on the body of the respective person and hold the usual tools such as hammers, wrenches, screwdrivers, pliers, etc., which are needed regularly by the particular person at his or her workplace. For example, such tool bags are often designed as tool belts, which are worn as a belt on the particular person. When working with a tool, it is unavoidable that the person working with the tool may drop the tool. Subsequent searching for the tool is usually troublesome and time-consuming. In addition, when working at a great height, there is the risk that someone else might be injured by the falling tool.

German Utility Model 297 09 358 U1 discloses a tool bag of the type defined in the preamble, this tool bag being wearable on the body of a person; it is designed as a vest having a plurality of receptacles for tools, in particular for gardening tools.

The present invention is concerned with the problem of providing an embodiment of a tool bag of the type defined in the preamble which will prevent loss of a tool when working.

This problem is achieved according to the present invention by a tool bag having the features of claim 1.

This invention is based on the general idea of securing each tool on the tool bag by means of a three-dimensionally flexible retaining line, whereby the particular retaining lines are attached to the respective tool and can be pulled out of the tool bag and retrieved automatically. To this end, each retaining line is attached to the tool bag by means of an extraction and retrieval device. The term "three-dimensionally flexible retaining line" as used here is understood to refer to a cord, a cable, a wire, a strand or even a chain, whereby the retaining line may transmit sufficient tensile forces and has a sufficient tensile strength.

Through this invention, each tool that is connected with a retaining line is attached to the tool bag so that it cannot be lost. The three-dimensional flexibility of the retaining line ensures unhindered working with the respective tool. The automatic retrieval arrangement ensures that the retaining line will always take up a minimum amount of space and in particular will not form any problematical loops which could snag the person on obstacles. In particular when the tool has been inserted into the particular receptacle, the retaining line is retrieved almost completely and is securely stowed.

In order for the retaining line to be arranged on the tool bag in an extractable and automatically retrievable manner, the tool bag has an extraction and retrieval device for each retaining line, thus permitting the extraction and automatic retrieval of the retaining line. Such an extraction and retrieval device has, for example, a spring-loaded reel on which the retaining line is wound. When the retaining line is pulled out, it is unwound from the reel, applying tension to the spring means. Automatic retrieval is then accomplished because of the spring force driving the reel to wind up the retaining line. Known extraction and retrieval devices are used, e.g., as keyrings, and therefore need not be explained further here.

According to a preferred embodiment, a line capsule may be provided for each retaining line, the extraction and retrieval device being accommodated in this capsule, which is attached to the tool bag. This line capsule thus forms a unit that can be attached separately, thus simplifying the manufacture of the tool bag.

In a further embodiment, the housing of the line capsule may be detachably attached to the tool bag with quick fasteners, e.g., clips or snap fasteners. This measure facilitates the production of the tool bag as well as facilitating the replacement of a defective line capsule, if necessary.

The tool bag may expediently have a carrier body made of leather on the front side of which is arranged the at least one receptacle and on the rear side of which the respective retaining line is attached by means of its extraction and retrieval device, whereby the retaining line passes through the carrier body in a through-hole. This measure results in a highly effective means of anchoring the retaining line on the tool bag. In addition, this arrangement results in a clear separation between the receptacles and the extraction and retrieval devices, thus preventing any mutual interference. Handling of the tool bag, e.g., insertion of a tool into the particular receptacle, is thus not hindered due to the extraction and retrieval devices.

In a further embodiment, a closable cover may be mounted on the rear side of the carrier body in such a way that when closed, it covers the extraction and retrieval device of the retaining line and when open it permits access to the extraction and retrieval device of the retaining line. Due to this design, it is especially easy to perform maintenance and repair work on the extraction and retrieval devices, in particular on the line capsules.

Depending on the given application, the retaining lines may be made of steel, e.g., steel cable, or an electrical insulation material, e.g., nylon. In the case of a head maintenance man in particular, it is important for the retaining line to be made of an electric insulation material.

In a further embodiment which is particularly expedient, a reserve retaining line having a respective extraction and retrieval device may be provided on the tool bag so that none of the tools assigned to the receptacles is assigned to this one. As a result of this measure, it is possible in case of need to secure an additional object, in particular an additional tool which is needed only on an exceptional basis, on the tool bag, even if no receptacle is provided for it on the tool bag.

Other important features and advantages of this invention are derived from the subclaims, the drawings and the respective description of the figures on the basis of the drawings.

Preferred exemplary embodiments of this invention are illustrated in the drawings and explained in greater detail in the following description.

Figure 2:
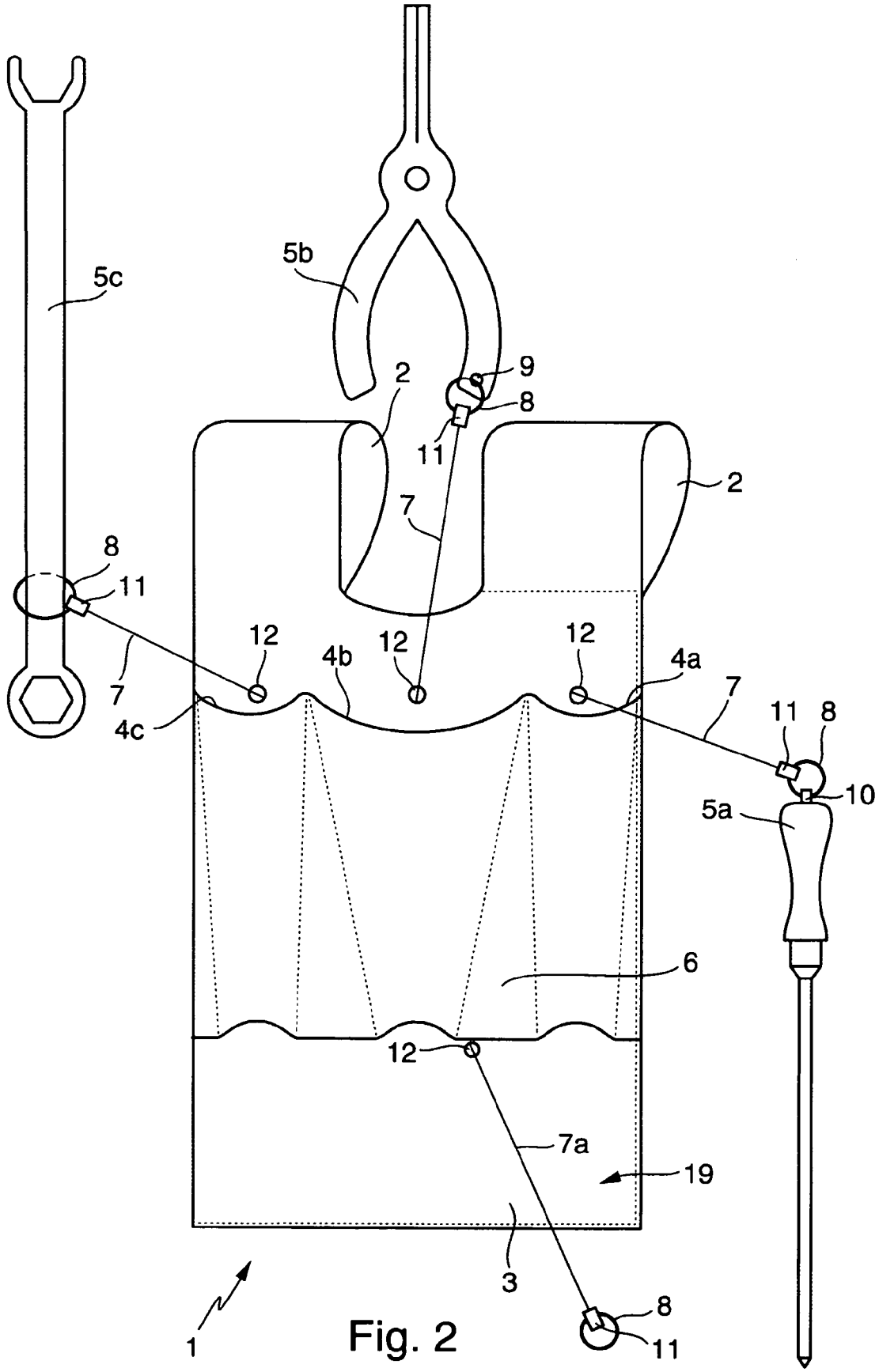
Figure 4:
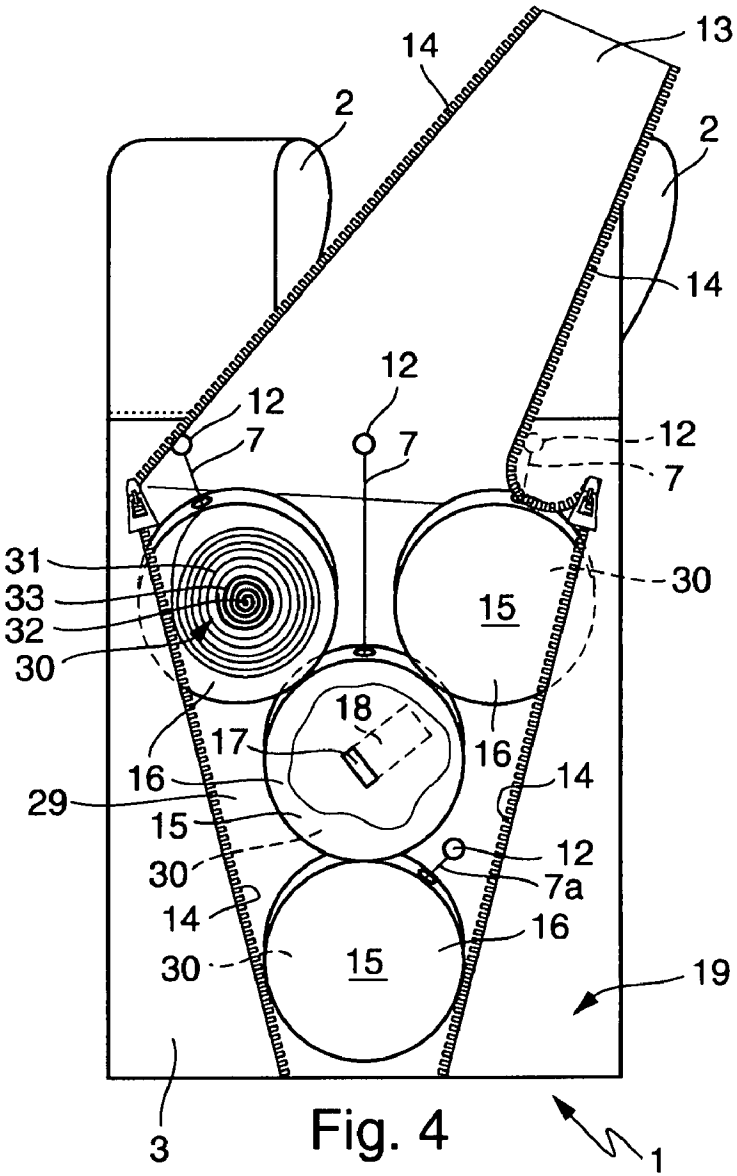
Figure 3:
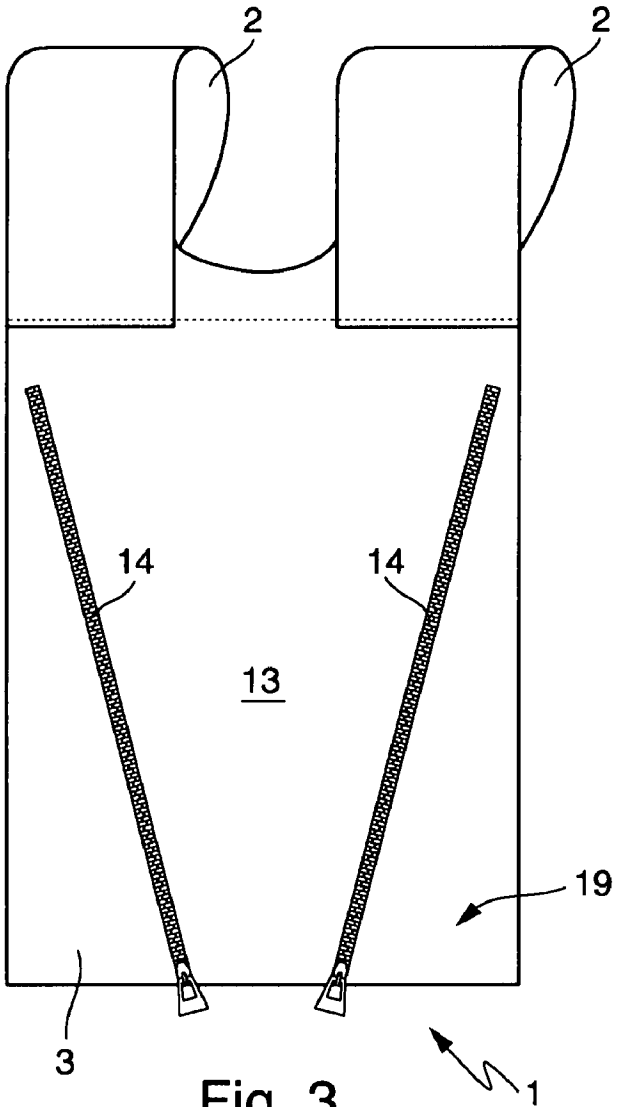
Figure 5:
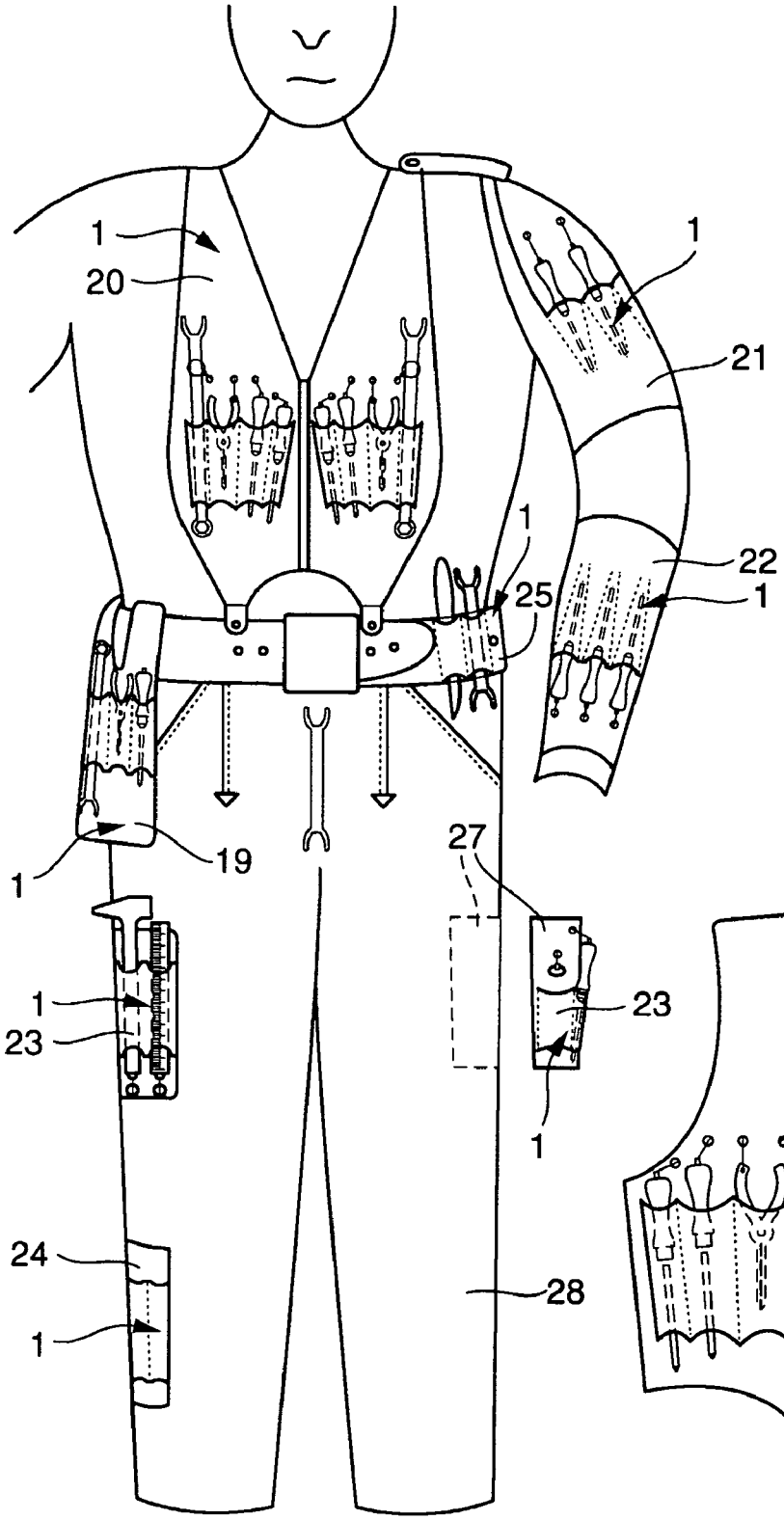
Figure 6:
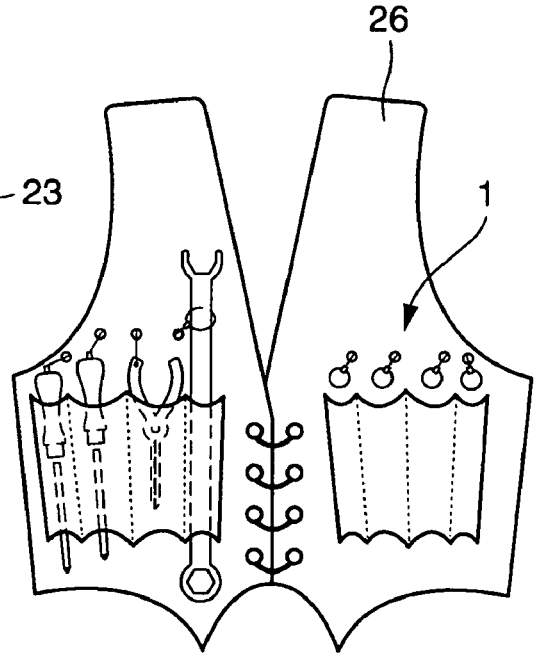

The drawing shows schematically:

FIG. 1 a front view of a particular embodiment of the inventive tool bag that can be worn on the body of a person, with tools accommodated in the receptacles;

FIG. 2 a view like that in FIG. 1, but with the tools removed from the receptacles;

FIG. 3 a rear view of the tool bag according to FIG. 1 with the cover closed;

FIG. 4 a view like that in FIG. 3, but with the cover open;

FIG. 5 a view of a person equipped with various tool bags according to this invention; and FIG. 6 a view of a particular embodiment of a tool bag according to this invention.

According to FIG. 1, an inventive tool bag 1 may be designed as a tool belt bag 19, for example, and accordingly may have at least one belt loop 2, namely two loops in the present case, with the help of which the tool bag 1 can be attached to a belt. The tool bag 1 has a carrier body 3, which is made of a relatively sturdy material, e.g., a coarse leather. A plurality of receptacles 4, namely three receptacles 4*a*, 4*b* and 4*c* here, are provided on a front side of the belt facing the viewer, each receptacle serving to accommodate one tool 5. Specifically, the tools 5 here include a screwdriver 5*a*, pliers 5*b* and a wrench 5*c*. According to a preferred embodiment, the receptacles 4*a*, 4*b*, 4*c* may be formed by a piece of neoprene 6, which is attached to the front side of the carrier body 3. The piece of neoprene 6 is preferably attached to the carrier body 3 by sewing. The receptacles 4*a* through 4*c* thus formed are characterized by high retaining forces for the tool 5*a* through 5*c* introduced into it and characterized by a high flexibility for different geometric configurations of tools. In addition, neoprene is very sturdy and weather resistant.

According to this invention, a retaining line 7 is provided for each tool 5; it is attached to the tool 5 in such a way that it can be pulled out of and automatically retrieved back into the tool bag 1. This attachment is accomplished in each case by means of a retraction and retrieval device 30, which is described below with respect to FIG. 4.

The safety line 7 consists of a steel cable, for example. It is likewise possible to manufacture the retaining line 7 from a chain or a cord or a cable. In addition, it is also possible to use an electric insulation material for the retaining line 7; for example, the retaining line 7 may be made of nylon. The retaining line 7 is of such dimensions that it has three-dimensional flexibility and has the required tensile strength and ultimate strength. On its extractable end, the retaining line 7 is attached to the particular tool 5 by means of a ring 8. In the case of wrench 5*c*, this ring 8 is located between the ends of the wrench 5*c* and has an inside cross section which prevents the wrench 5*c* from being pulled out of the ring 8. To attach the retaining line 7 to the pliers 5*b*, the line is equipped with an opening 9 into which the ring 8 is inserted. The screwdriver 5*a* is provided with an eyelet 10 into which the ring 8 is inserted. A coupling member 11 with which the retaining line 7 is attached to the ring 8 may preferably be designed so as to allow rotational movement between the ring 8 and the retaining line 7 without causing the retaining line 7 to become twisted.

In addition to the three retaining lines 7, each being paired with a certain tool 5, the special tool bag 1 shown here is additionally equipped with a reserve retaining line 7*a*, which is arranged here beneath the neoprene piece 6 on the carrier body 3. An additional tool or the like, which is needed in exceptional cases, may be attached to this reserve retaining line 7*a*.

The retaining lines 7 each pass through the carrier body 3 in a through-hole 12 which may be formed by a metal eyelet, for example.

According to FIG. 2, the retaining lines 7 are secured on the tool bag 1 in such a way that they can be extracted, i.e., pulled out, so that the tools 5 together with the retaining line 7 attached to them can be removed from their receptacles 4 and used in the usual manner. The three-dimensional flexibility of the retaining line 7 ensures the greatest possible freedom of movement. When the particular tool 5 is inserted back into the particular receptacle 4, the automatic retrieval of the retaining line 7 causes it to be automatically retracted through the through-holes 12 so that the retaining lines 7 are always put away in a space-saving manner. Since the retaining lines 7 are fixedly connected to the tool bag 1, the tools 5 attached thereto are secured on the tool bag 1 in such a way that they cannot be lost. If a tool 5 falls down, it can be retrieved by its retaining line 7.

According to FIGS. 3 and 4, a closable cover 13 may be provided on the rear side of the carrier body 3 which faces the observer by means of two zipper closures 14. In FIG. 3 the cover 13 is closed, but in FIG. 4 it is open.

According to FIG. 4, one line capsule 15 is provided on the back side of the carrier body 3 for each retaining line 7. Each of these line capsules 15 has a housing 16 which accommodates one of the retraction and retrieval devices 30 that cooperates with the respective retaining line 7 for extraction and retrieval.

FIG. 4 shows a sectional view of one of the line capsules 15 to illustrate the retraction and retrieval device 30 accommodated therein in greater detail. This extraction and retrieval device 30 consists, for example, of a reel which is rotatably mounted so it is concentric with a stationary pin 32. A retrieval spring 33 is arranged between the pin 32 and the reel 31. The retaining line 7 is wound up onto the reel 31. In pulling out the retaining line 7, it is unwound from the reel 31, as the reel rotates about the pin 32 and puts tension on the retrieval spring 33. In retraction, the retrieval spring 33 drives the reel 31 to wind up the retaining line 7 onto the reel.

The line capsules 15 are attached to the rear side of the carrier body 3 in which case quick fastening means are preferred. For example, the carrier body 3 may be designed with double walls and having an insertion slot 17 on the rear side into which a clip strap 18 that is provided on the housing 16 can be inserted. For a simplified diagram, the center line capsule 15 is shown in an exploded diagram.

The double walls of the carrier body 3 may be created, for example, by means of a sheet 29, e.g., made of plastic or leather, inserted into it, with the insertion slot 17 provided in that. In addition the rigidity and stability of the overall tool bag 1 can also be increased by such a sheet 29.

The clip straps 18 inserted into the insertion slot 17 may form elevations on the front side which could interfere with insertion of the tool 5 within the receptacle 4. To prevent or reduce such elevations, an additional sheet, e.g., made of leather or plastic may be placed on the carrier body 3 on the front side in a further embodiment of this invention. This sheet is expediently identical to the neoprene piece 6 and thus forms an inside wall of the receptacles 4 without any interfering contour. The neoprene piece 6 is placed on this sheet, with the sheet and the neoprene piece 6 expediently being sewn together onto the carrier body 3.

When the cover 13 is open according to FIG. 4, the line capsules 15 are accessible and can be installed or dismantled. When the cover 13 is closed according to FIG. 3 the line capsules 15 are covered and protected.

As shown in FIG. 4, the bottom reserve retaining line 7*a* is also equipped with its particular line capsule 15.

Preferably the extraction and retrieval devices 30 of the retaining lines 7*a* are designed so that a retrieval tension is permanently induced in the retaining line 7*a*. Accordingly, the retaining lines 7 are always under tension to ensure the shortest possible linear connection between tool bag 1 and tool 5. This is advantageous in particular in constricted workplaces.

In another embodiment, however, at least one of the extraction and retrieval devices 30 may be designed so that automatic retrieval of the retaining line 7 occurs only when the retaining line 7 has been pulled out to the maximum extent, i.e., to a stop. This means that the retaining line 7 is situated relatively loosely between the tool 5 and the tool bag 1 after it has been pulled out. Only after the maximum extraction is the retrieval tension induced in the retaining line 7. This embodiment can facilitate working with the tool 5 in certain types of applications.

According to FIG. 5, different embodiments can be implemented for the tool bag 1. In addition to the embodiment shown in FIGS. 1 through 4 as tool belt 19, the tool bag 1 may also be designed as a tool vest 20, an upper arm holster 21, a forearm cuff 22, a thigh holster 23, a lower leg cuff 24 or simply as a belt 25. According to FIG. 6, an embodiment as a vest 26 or jacket with or without arms is also possible.

FIG. 5 illustrates another special embodiment in which the tool bag 1, e.g., in the form of a thigh holster 23 can be detachably attached to an item of clothing such as pants 28 with a VELCRO® type zipper (VELCRO® is a trademark which identifies hook and loop fastening material) closure 27.

Although the tool bag 1 is designed in all the embodiments shown here in such a way that it can be worn on the body of a person, it is self-evident that the tool bag 1 according to this invention can also be attached at least temporarily to another object, e.g., a framework of the like.

The invention claimed is:

1. A hand tool bag, that can be worn on the body of a person for carrying hand tools, comprising:

a) at least two flexible retaining lines;

b) a carrier body having a front side and a back side and at least two through-holes formed in said front side for allowing said at least two flexible retaining lines to pass there-through;

c) at least two hand tools with a first hand tool being of a first size, and a second hand tool being a second size, said first hand tool being connected to a first retaining line of said at least two flexible retaining lines, and said second hand tool being connected to a second retaining line of said at least two flexible retaining lines;

d) at least two receptacles, arranged on said front side of said carrier body, comprising a first receptacle which is larger than a second receptacle wherein said first receptacle is sized for receiving said first hand tool and said second receptacle, is sized for receiving said second hand tool, wherein each receptacle has a first end which forms an opening for receiving at least one of said at least two hand tools;

e) at least two extraction and retrieval devices coupled to said back side of said carrier body wherein each of said at least two extraction and retrieval devices provides retrieval tension on each of said at least two hand tools; and wherein said at least two flexible retaining lines are each coupled at a first end to at least one of said at least two extraction and retrieval devices and at a second end to an extractable end of at least one of said at least two hand tools wherein said at least two through holes are positioned apart from said extractable end of said at least one of said at least two hand tools to keep said at least one of said at least two hand tools in at least one of said at least two receptacles.

2. The hand tool bag according to claim 1, wherein a line capsule is provided for each of said at least two flexible retaining lines, said line capsule having a housing in which at least one of said at least two extraction and retrieval devices is accommodated and which is attached to the hand tool bag.

3. The hand tool bag according to claim 2, wherein the housing of the line capsule is detachably attached to the hand tool bag with quick fastening means.

4. The hand tool bag according to claim 1, further comprising a closable cover which is mounted on the back side of the carrier body; wherein when said closeable cover is closed, said closable cover covers at least one of said at least two extraction and retrieval devices of the at least two flexible retaining lines and when opened, permits access to at least one of said at least two extraction and retrieval devices.

5. The hand tool bag according to claim 4, wherein the closable cover is closably mounted on the carrier body by means of at least one zipper.

6. The hand tool bag according to claim 1, wherein at least one of said at least two flexible retaining lines is designed as a chain or cable or a wire cable or cord.

7. The hand tool bag according to claim 1, wherein at least one of said at least two flexible retaining lines is made of steel or an electric insulation material.

8. The hand tool bag according to claim 1, further comprising a reserve retaining line coupled at a first end to an extraction and retraction device disposed in the hand tool bag and not assigned to any hand tool which is assigned to said at least one of said at least two receptacles.

9. The hand tool bag according to claim 1, wherein said at least one of said at least two receptacles is formed by a piece of neoprene which is attached to the front side of the carrier body of the hand tool bag.

10. The hand tool bag according to claim 1, wherein the hand tool bag is designed as a hand tool vest or as an upper arm holster or as a forearm cuff or as a hand tool belt bag or as a thigh holster or as a lower leg cuff or simply as a belt or a vest or as a jacket.

11. The hand tool bag according to claim 1, wherein the hand tool bag is detachably attached to an item of clothing with a hook and loop type zipper closure.

12. The hand tool bag as in claim 1, further comprising at least one metal eyelet coupled to at least one of said at least two through-holes.

13. The hand tool bag as in claim 1, wherein said at least two receptacles are for holding said at least two hand tools taken from the group consisting of: screwdriver, pliers, and wrench.

14. A hand tool bag, that can be worn on the body of a person for carrying hand tools, comprising:

a) at least two flexible retaining lines;

b) a carrier body having a front side and a back side and at least two through-holes formed in said front side for allowing one of said at least two flexible retaining lines to pass there-through;

c) at least two receptacles, arranged on said front side of said carrier body, comprising a first receptacle which is larger than a second receptacle, wherein said first receptacle is sized for receiving a first hand tool of a first size and said second receptacle is sized for receiving a second hand tool wherein each receptacle has a first end which forms an opening for receiving at least one of said first and second hand tools;

d) at least two extraction and retrieval devices coupled to said back side of said carrier body wherein each of said at least two extraction and retrieval devices provides retrieval tension on each of said first and second tool; and wherein each of said at least two flexible retaining lines are coupled at a first end to one of said at least two extraction and retrieval devices and at a second end to an extractable end of one of said first and second hand tools wherein said through holes are positioned apart from said extractable end of said one of said first and second hand tools to keep one of said first and second hand tools in at least one of said at least two receptacles.

* * * * *

UNITED STATES PATENT AND TRADEMARK OFFICE

CERTIFICATE OF CORRECTION

PATENT NO. : 7,658,307 B2
APPLICATION NO. : 10/474534
DATED : February 9, 2010
INVENTOR(S) : Klaus Peter Skupin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 710 days.

Signed and Sealed this

Thirtieth Day of November, 2010

David J. Kappos

David J. Kappos
*Director of the United States Patent and Trademark Office*